US008837984B2

(12) United States Patent
Fukamachi

(10) Patent No.: US 8,837,984 B2
(45) Date of Patent: Sep. 16, 2014

(54) IMAGE FORMING SYSTEM

(75) Inventor: Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 128 days.

(21) Appl. No.: 13/599,002

(22) Filed: Aug. 30, 2012

(65) Prior Publication Data

US 2013/0051821 A1 Feb. 28, 2013

(30) Foreign Application Priority Data

Aug. 30, 2011 (JP) ..... 2011-186880

(51) Int. Cl.

| | |
|---|---|
| ***G03G 15/04*** | (2006.01) |
| ***G03G 15/08*** | (2006.01) |
| ***G03G 21/18*** | (2006.01) |
| ***G03G 21/16*** | (2006.01) |

(52) U.S. Cl.

CPC ..... *G03G 15/0896* (2013.01); *G03G 21/1814* (2013.01); *G03G 21/1676* (2013.01)

USPC ..... 399/119; 399/111

(58) Field of Classification Search

CPC ..... G03G 15/0896; G03G 21/1676; G03G 21/1814

USPC ..... 399/111, 119

See application file for complete search history.

(56) References Cited

U.S. PATENT DOCUMENTS

| | | | | |
|---|---|---|---|---|
| 5,826,132 | A | 10/1998 | Damji et al. | |
| 5,966,568 | A | 10/1999 | Numagami et al. | |
| 5,987,278 | A * | 11/1999 | Nomura et al. | 399/109 |
| 7,346,297 | B2 | 3/2008 | Kawakami et al. | |
| 2002/0048463 | A1 * | 4/2002 | Otomo et al. | 399/27 |
| 2005/0207786 | A1 * | 9/2005 | Askren et al. | 399/119 |
| 2006/0204284 | A1 | 9/2006 | Kawakami et al. | |
| 2009/0041498 | A1 | 2/2009 | Numagami et al. | |
| 2010/0104327 | A1 * | 4/2010 | Handa et al. | 399/263 |
| 2010/0202798 | A1 * | 8/2010 | Suzuki et al. | 399/119 |
| 2012/0076549 | A1 * | 3/2012 | Fujii | 399/262 |

FOREIGN PATENT DOCUMENTS

| | | | |
|---|---|---|---|
| JP | 06-019238 | A | 1/1994 |
| JP | 10-187008 | A | 7/1998 |
| JP | 11-219091 | A | 8/1999 |
| JP | 2006-251610 | A | 9/2006 |

OTHER PUBLICATIONS

The First Office Action mailed Mar. 4, 2014, CN Appln. 201210314007.1, English translation.

* cited by examiner

*Primary Examiner* — Ryan Walsh
(74) *Attorney, Agent, or Firm* — Banner & Witcoff, Ltd.

(57) ABSTRACT

An image forming system includes a first developer container, a second developer container having a capacity larger than the first developer container, and an image forming main unit having a structure configured to allow one developer container selected from a group including the first and second developer containers to be removably installed therein. Each of the first and second developer containers includes a housing configured to form a developer storage chamber in which developer is storable, and a developer agitating member. The agitating member of the first developer container has a construction equivalent to that of the second developer container. Lower portions of the housings are equally positioned relative to the corresponding agitating member and have equally shaped inner surfaces, while portions other than the lower portions of the housings are shaped differently from each other.

5 Claims, 4 Drawing Sheets

IMAGE FORMING SYSTEM

CROSS-REFERENCE TO RELATED APPLICATION(S)

This application claims priority from Japanese Patent Application No. 2011-186880 filed on Aug. 30, 2011, the disclosure of which is incorporated herein by reference in its entirety.

FIELD

Apparatuses or systems consistent with one or more aspects of the present invention relate to an image forming system including a developer container configured to store developer, and an image forming unit having a structure configured to allow the developer container to be installed therein or removed therefrom.

BACKGROUND

An image forming apparatus or system of a specific type known in the art has a structure configured to allow a developer container (e.g., embodied in a development cartridge) in which developer is storable, to be installed in or removed from the main body. To be more specific, for example, a development cartridge may include a developer container having a lid member and a container body openably closed with the lid member, and an agitating member configured to agitate developer in the developer container. In some configurations, optionally, the capacity of the developer container can be changed by changing the lid member into another lid member having a different shape.

When the developer storage capacity of the development cartridge is changed by replacing one developer container with another developer container which has a differently shaped lid member, changes would also be effected in various properties such as the position of the center of rotation, the radius of rotation, the rotation speed, and the length and thickness of the agitating member. This would result in the change of the performance of the agitating member in agitating and conveying the developer.

There is a need of maintaining the performance of the agitating member in agitating and conveying developer, while the developer container can be adapted to have an intended capacity corresponding to a desired amount of developer to be stored in the developer container.

SUMMARY

It is one aspect to provide an image forming system in which the aforementioned need is satisfied.

More specifically, according to one or more embodiments of the present invention, an image forming system is provided which comprises a first developer container that is configured to store developer, a second developer container that is configured to store developer and has a capacity larger than that of the first developer container, and an image forming main unit having a structure configured to allow one developer container selected from the group including the first developer container and the second developer container to be removably installed therein. The first developer container includes a first housing and a first agitating member. The first housing is configured to form a first developer storage chamber in which developer is storable. The first agitating member is rotatable to agitate the developer in the first developer storage chamber. The second developer container includes a second housing and a second agitating member. The second housing is configured to form a second developer storage chamber in which developer is storable. The second agitating member is rotatable to agitate the developer in the second developer storage chamber. The second agitating member has a construction equivalent to that of the first agitating member. The first housing includes a lower portion that defines a lower part of the first developer storage chamber and is disposed below an axis of rotation of the first agitating member. The second housing includes a lower portion that defines a lower part of the second developer storage chamber and is disposed below an axis of rotation of the second agitating member. The lower portions of the first and second housings are equally positioned relative to the corresponding agitating member and have equally shaped inner surfaces, while the first and second housings further include portions that define parts of the first and second developer storage chambers other than the lower parts defined by the lower portions, and have inner surfaces shaped differently from each other whereby the capacity of the second developer storage chamber is larger than that of the first developer storage chamber.

BRIEF DESCRIPTION OF THE DRAWINGS

The above aspect, various configurations, their advantages and further features of the present invention will become more apparent by describing in detail illustrative, non-limiting embodiments thereof with reference to the accompanying drawings, in which.

DESCRIPTION OF EMBODIMENTS

Figure 1:
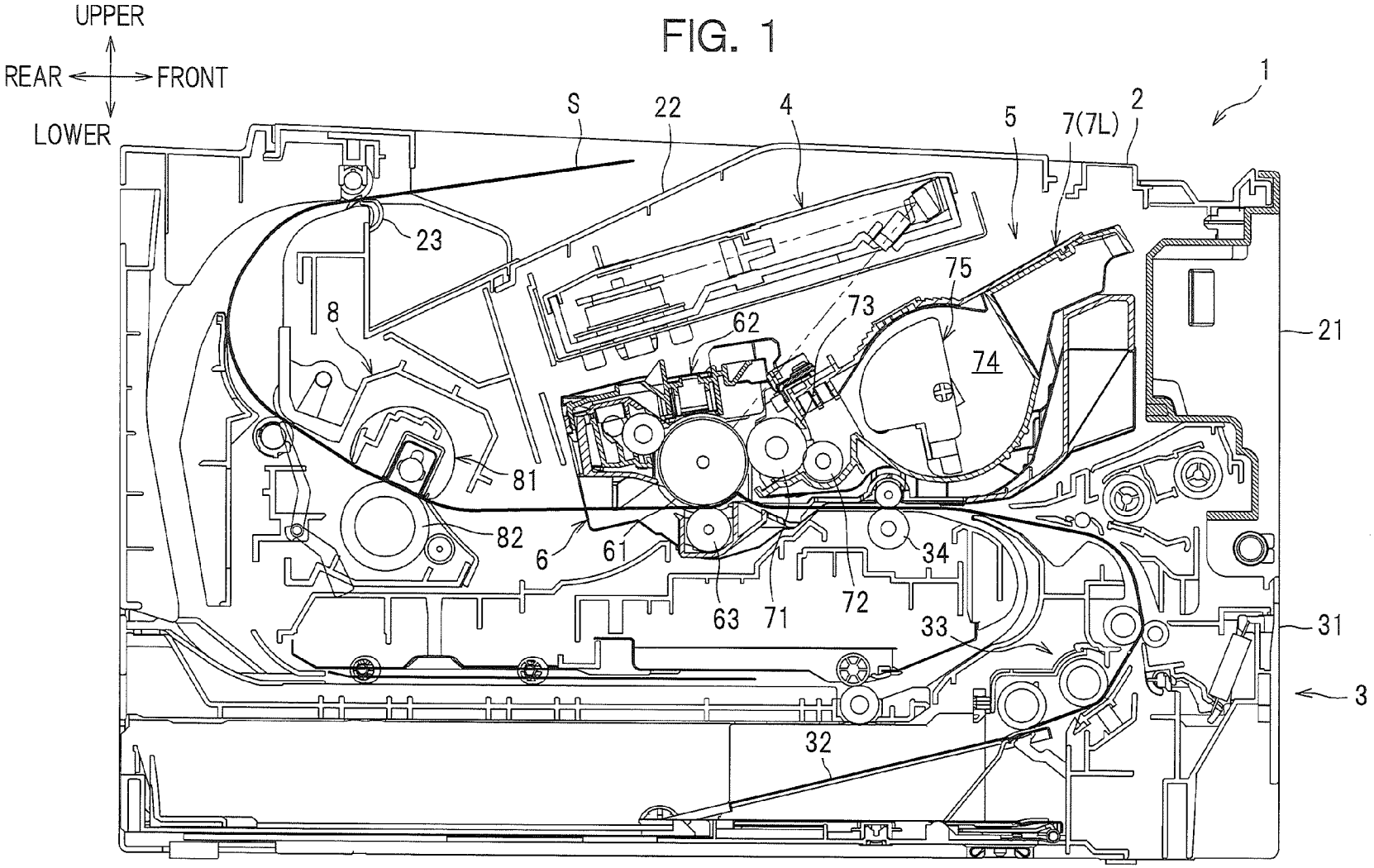
FIG. 1 is a schematic diagram of a laser printer as an example of an image forming apparatus.

A detailed description will be given of an illustrative embodiment of the present invention with reference to the drawings. In the following description, a general setup of a laser printer 1 as an example of an image forming apparatus will be described at the outset, and then features relating to development cartridges 7 (developer containers) will be described in detail.

Hereinbelow, the direction is designated as from the viewpoint of a user who is using (operating) the laser printer 1. To be more specific, in FIG. 1, the right-hand side of the drawing sheet corresponds to the "front" side of the printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction of a line extending from top to bottom of the drawing sheet corresponds to the "vertical" or "up/down (upper/lower or top/bottom)" direction of the printer.

<General Setup of Laser Printer>

As shown in FIG. 1, the laser printer 1 comprises a body casing 2, and several components housed within the body casing 2 which principally include a sheet feeder unit 3 configured to feed a sheet S (e.g., of paper), an exposure device 4, a process cartridge 5 configured to transfer a toner image (developer image) onto the sheet S, and a fixing device 8 configured to thermally fix the toner image on the sheet S.

Herein, the body casing 2 in which these components are incorporated is an example of an image forming main unit from which a development cartridge 7 as an example of a developer container is removable.

The sheet feeder unit 3 is provided in a lower space within the body casing 2, and principally includes a sheet feed tray 31, a sheet pressure plate 32, a sheet feed mechanism 33 and a registration roller 34. Sheets S stored in the sheet feed tray 31 are pushed up by the sheet pressure plate 32, and one sheet S separated from the others is fed by the sheet feed mechanism 33 toward the process cartridge 5, and passes through the registration roller 34 in which the sheet S is aligned in registration and gets ready to be conveyed into an interface between a photoconductor drum 61 and a transfer roller 63 in a photoconductor unit 6.

The exposure device 4 is provided in an upper space within the body casing 2, and principally includes a laser beam emitter (not shown), a polygon mirror, lenses and reflecting mirrors (shown in part, but indication with reference characters omitted). The exposure device 4 is configured to cause a laser beam produced based upon image data by the laser beam emitter to travel along a path indicated by alternate long and short dashed lines, so that a peripheral surface of the photoconductor drum 61 is rapidly scanned and illuminated consecutively with the laser beam.

The process cartridge 5 is disposed below the exposure device 4 within the body casing 2, and configured to be installable in and removable from the body casing 2 through an opening formed when a front cover 21 provided at the body casing 2 is swung open. The process cartridge 5 includes a photoconductor unit 6 and a development cartridge 7.

The photoconductor unit 6 principally includes a photoconductor drum 61 as an example of a photoconductor, a charger 62 and a transfer roller 63.

The development cartridge 7 is configured to be detachably attachable to the photoconductor unit 6, and thus is removably installable together with the photoconductor unit 6 (i.e., as a part of the process cartridge 5) in the body casing 2. The development cartridge 7 principally includes a development roller 71, a supply roller 72, a doctor blade 73, a toner reservoir (toner storage chamber) 74 which is configured to store toner (as an example of developer) therein, and an agitator 75.

In the process cartridge 5, the peripheral surface of the photoconductor drum 61 is uniformly charged by the charger 62, and then exposed to a rapidly sweeping laser beam from the exposure device 4 so that an electrostatic latent image formulated based upon image data is formed on the photoconductor drum 61. Meanwhile, toner in the toner reservoir 74 is being agitated by the agitator 75, and is supplied first to the supply roller 72 and then from the supply roller 72 to the development roller 71. As the development roller 72 rotates, the toner goes through between the development roller 71 and the doctor blade 73 so that a thin layer of toner having a predetermined thickness is carried on the development roller 71.

The toner carried on the development roller 71 is supplied from the development roller 71 to the electrostatic latent image formed on the photoconductor drum 61. Accordingly, the electrostatic latent image is visualized and a toner image is formed on the photoconductor drum 61. Thereafter, while a sheet S is conveyed through between the photoconductor drum 61 and the transfer roller 63, the toner image on the photoconductor drum 61 is transferred onto the sheet S.

The fixing device 8 is disposed rearwardly of the process cartridge 5. The fixing device 8 principally includes a heating unit 81 and a pressure roller 82. The heating unit 81 includes a halogen heater, a fixing belt, a nip plate and other components which are shown but of which indication with reference characters is omitted. The pressure roller 82 is disposed opposite to the nip plate of the heating unit 81 and configured to be pressed against the nip plate so that the fixing belt of the heating unit 81 is nipped between the pressure roller 82 and the nip plate of the heating unit 81. In the fixing device 8, a sheet S with a toner image transferred thereon is conveyed through between the pressure roller 82 and the heated fixing belt of the heating unit 81, so that the toner image is thermally fixed on the sheet S. The sheet S with the toner image thermally fixed thereon is ejected by a sheet ejection roller 23 onto a sheet output tray 22.

<Detailed Structure of Development Cartridge>

Figure 2:
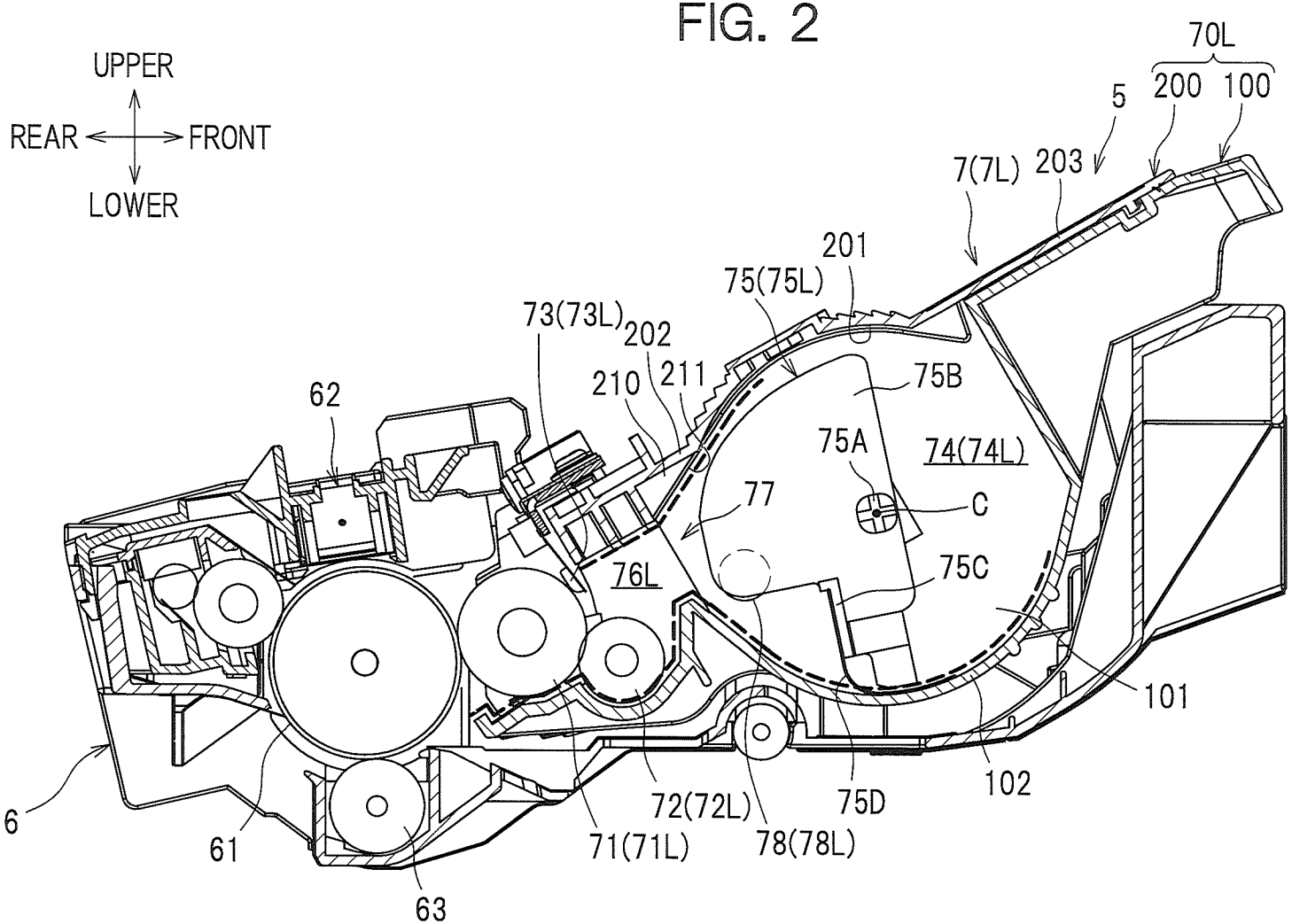
FIG. 2 is a sectional view of a process cartridge including a small-capacity cartridge.
Figure 3:
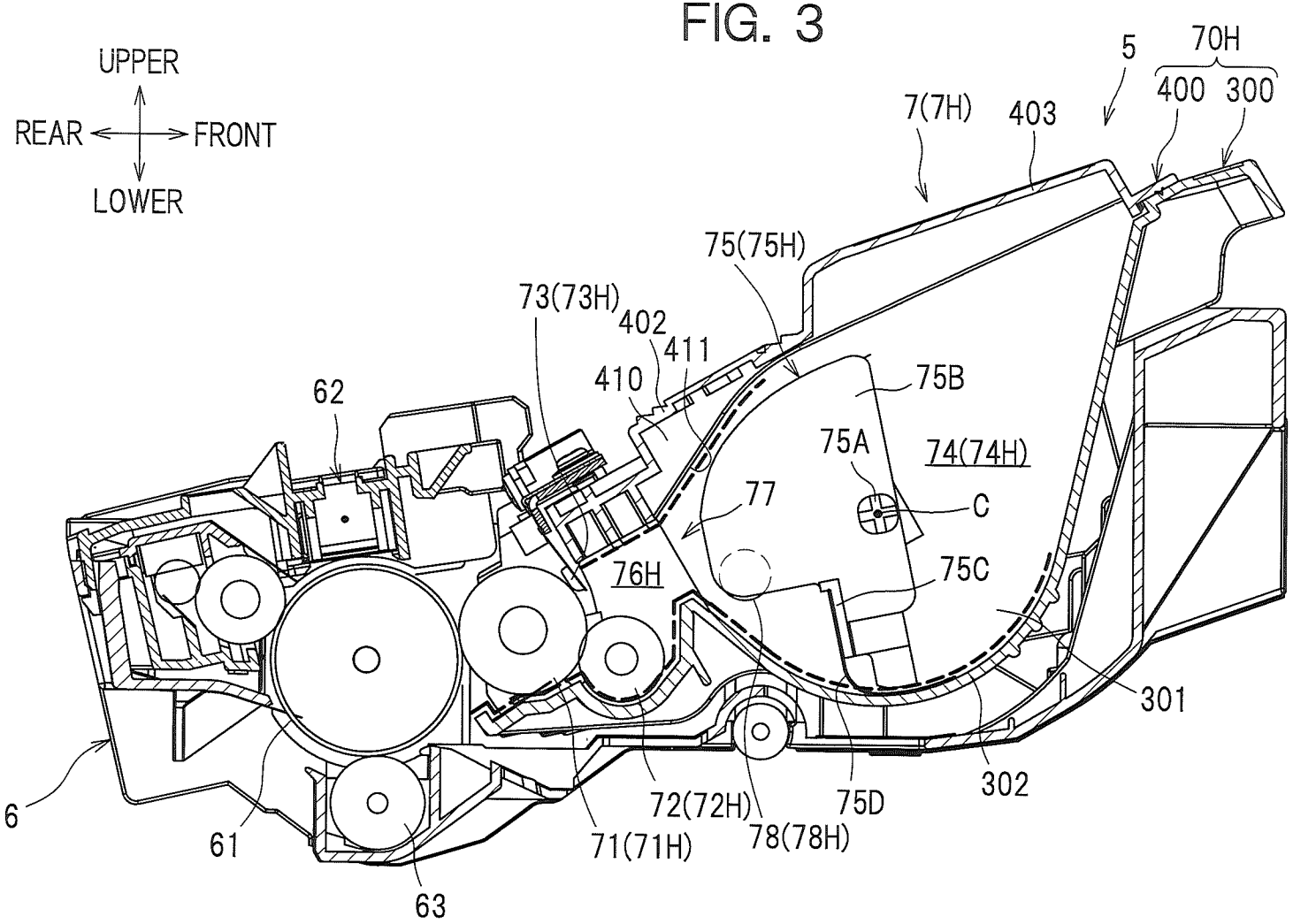
FIG. 3 is a sectional view of a process cartridge including a large-capacity cartridge.

The image forming system according to the present embodiment is configured such that either one of two types of development cartridge 7 of which capacities of toner reservoirs 74 are different from each other (to be more specific, a small-capacity cartridge 7L as an example of a first developer container as shown in FIG. 2 and a large-capacity cartridge 7H as an example of a second developer container as shown in FIG. 3) is removably installable in a predetermined position within the body casing 2 of the laser printer 1.

As shown in FIG. 2, the small-capacity cartridge 7L includes a first housing 70L, a development roller 71L as an example of a first developer bearing member, a supply roller 72L as an example of a first developer supply member, a doctor blade 73L as an example of a first doctor blade, and an agitator 75L as an example of a first agitating member.

The development roller 71L is a roller configured to bear or carry developer. The supply roller 72L is a roller configured to supply toner to the development roller 71L. The doctor blade 73L is a member configured to regulate a thickness of developer on the development roller 71L. The development roller 71L, the supply roller 72L and the doctor blade 73L are disposed within a first development chamber 76L formed by the first housing 70L which will be described later in detail.

The agitator 75L is configured to rotate, to thereby agitate and convey toner in a first toner reservoir 74L (first developer storage chamber) toward the first development chamber 76L. The agitator 75L is disposed in the first toner reservoir 74L. The agitator 75L comprises a rotary shaft 75A, a set of agitating blades 75B, a connecting portion 75C, and a flexible sheet 75D.

The rotary shaft 75A is a shaft extending in the right-left direction, and both end portions thereof are rotatably supported at right and left sidewalls 101 (only one of which is shown) of the first housing 70L.

The agitating blades 75B, each shaped like a plate fit to agitate toner, are arranged at intervals in the right-left direction along the rotary shaft 75A. Each agitating blade 75B is angled with its lower end (in FIG. 2) set in a position shifted inwardly to some extent, and its upper end (in FIG. 2) set in a position shifted outwardly to some extent, from a direction perpendicular to the right-left direction. Accordingly, as the rotary shaft 75A rotates, toner while being agitated is conveyed toward the center in the right-left direction.

The connecting portion 75C is a plate-like member extending in the right-left direction to connect the rear ends of the agitating blades 75B. The connecting portion 75C has a rear side (a surface facing to the rear in FIG. 2) to which one edge of the flexible sheet 75D is attached.

The flexible sheet 75D is a sheet-like member formed of a flexible resin material such as PET. The flexible sheet 75D is configured to have a length such that a free end of the flexible sheet 75D (i.e., an edge opposed to the one edge of the flexible sheet 75D attached to the rear side of the connecting portion 75C) can be brought into contact with an inner surface of a wall which defines the first toner reservoir 74L. Therefore, as the rotary shaft 75A rotates, toner while being agitated is fed into the first development chamber 76L.

The first housing 70L principally includes a small-capacity lower frame 100 as an example of a first frame which is configured in a manner that permits the development roller 71L, the supply roller 72L and the agitator 75L to be rotatably supported therein, and a small-capacity upper frame 200 as an example of a second frame which is configured in a manner that permits the doctor blade 73L to be fixed thereto. When the small-capacity lower frame 100 and the small-capacity upper frame 200 are combined together (e.g., welded together), the first toner reservoir 74L and the first development chamber 76L are formed.

The first toner reservoir 74L is a chamber for storing toner therein, and formed in a front portion of the small-capacity cartridge 7L. The first development chamber 76L is a chamber for accommodating the development roller 71L, the supply roller 72L and the doctor blade 73L, and formed in a rear portion of the small-capacity cartridge 7L. The first toner reservoir 74L and the first development chamber 76L are in communication with each other via a communication passage 77.

The small-capacity lower frame 100 principally includes a pair of sidewalls 101 (of which only one is illustrated) disposed opposite to each other in the right-left direction, and a connecting wall 102 disposed to extend in the right-left direction to connect lower-to-front ends of the pair of sidewalls 101. The right and left sidewalls 101 are configured to form sidewalls of the first development chamber 76L and the first toner reservoir 74L. The connecting wall 102 is configured to form a bottom wall of the first development chamber 76L and bottom and front walls of the first toner reservoir 74L.

Portions of the right and left sidewalls 101 which form the first toner reservoir 74L have a pair of light-transmitting regions 78L disposed opposite to each other in the right-left direction. The light-transmitting regions 78L are transparent portions located in the same position in the respective sidewalls 101 that is closer to a rear edge of the portion of the sidewall 101 which forms the first toner reservoir 74L (i.e., near the communication passage 77), and shaped substantially like a circle in side view.

A brief description will now be given of a specific structure for use in determining whether or not the time is ripe for the development cartridge 7 to be replaced, according to the present embodiment.

Figure 4:
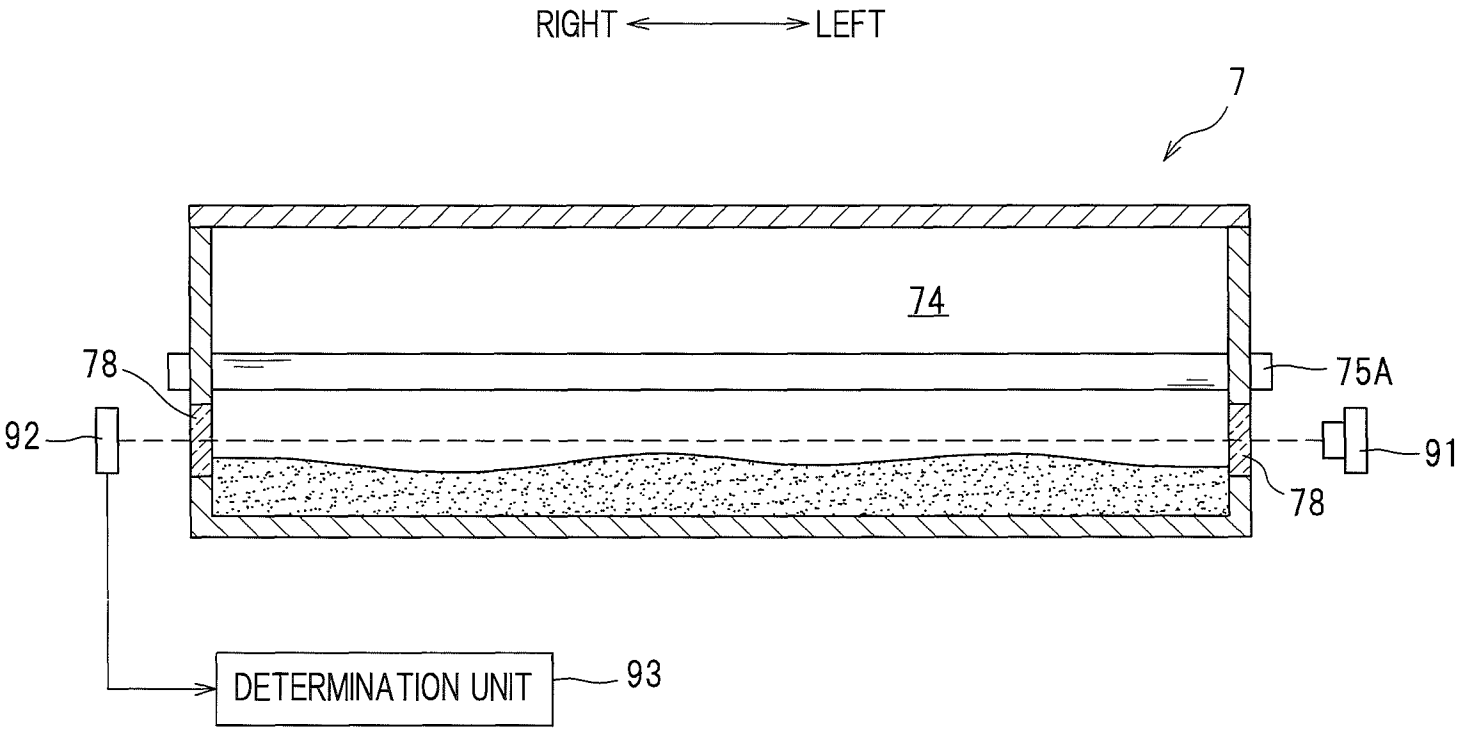
FIG. 4 is diagram for explaining a configuration for determination as to whether or not the time is ripe for the developer container to be replaced.

As shown in FIG. 4, one light-emitting element 91, one light-receiving element 92 and a determination unit 93 are provided in the body casing 2.

The light-emitting element 91 and the light-receiving element 92 are disposed opposite to each other in positions directly outside the light-transmitting regions 78 of the sidewalls 101, respectively, of the development cartridge 7 installed in the body casing 2. That is, the light-transmitting regions 78 are disposed in positions sandwiched between the light-emitting element 91 and the light-receiving element 92. The light-emitting element 91 and the light-receiving element 92 may be embodied, for example, by a known optical sensor. Light emitted from the light-emitting element 91 (indicated by broken line in FIG. 4) passes through one of the light-transmitting regions 78, enters the development cartridge 7 (toner reservoir 74), passes through the other of the light-transmitting regions 78, and strikes the light-receiving element 92. The light-receiving element 92 having received the light produces an output signal corresponding to the intensity of the received light, and outputs the signal to the determination unit 93.

The determination unit 93 is a device provided in an appropriate position within the body casing 2 and configured to determine whether or not the time is ripe for the development cartridge 7 to be replaced, based on the signal outputted from the light-receiving element 92. To be more specific, the determination unit 93 is configured to determine that the time is ripe for the development cartridge 7 to be replaced, for example, if the output signal is greater than a predetermined value, or if the ratio of a time period for which the output signal is greater than a predetermined value to a predetermined period of time is greater than a determination threshold. Specific methods applicable for determination in accordance with the present embodiment is not limited to the aforementioned examples, and it is to be appreciated that any know method can be adopted.

Referring back to FIG. 2, the small-capacity upper frame 200 is illustrated as a lid-like frame fixed to upper surfaces of the sidewalls 101 and the connecting wall 102 of the small-capacity lower frame 100. The small-capacity upper frame 200 forms an upper wall of the first toner reservoir 74L. The small-capacity upper frame 200 is configured to extend substantially straight and obliquely from a lower and rear position to an upper and front position as viewed in cross section, and includes a substantially arcuate recess 201 which is recessed outwardly of the first housing 70L. The recess 201 is located substantially in the midsection of the small-capacity upper frame 200 in the front-rear direction and contoured along a path of the rotary motion of the agitator 75L.

The small-capacity upper frame 200 includes first ribs 210. The first ribs 210 are provided on an undersurface of a portion of the small-capacity upper frame 200 which forms the first toner reservoir 74L. The first ribs 210, each extending in the front-rear direction, are arranged in positions spaced out in the right-left direction (only one first rib 210 is illustrated in FIG. 2) on the undersurface of the small-capacity upper frame 200. Lower sides of the first ribs 210 form a sliding surface along which the free end of the flexible sheet 75D of the agitator 75L being caused to rotate is slidable. In the following description, a rear-side portion (indicated in FIG. 2 as a region covered by a bold broken line) of the sliding surface (lower sides) of the first ribs 210 will be referred to as "first sliding surface 211".

As shown in FIG. 3, the large-capacity cartridge 7H includes a second housing 70H, a development roller 71H as an example of a second developer bearing member, a supply roller 72H as an example of a second developer supply member, a doctor blade 73H as an example of a second doctor blade, and an agitator 75H as an example of a second agitating member.

In the present embodiment, the development roller 71H, the supply roller 72H, the doctor blade 73H and the agitator 75H of the large-capacity cartridge 7H have the same constructions as those of the development roller 71L, the supply roller 72L, the doctor blade 73L and the agitator 75L of the small-capacity cartridge 7L, respectively. Further, in the present embodiment, the development roller 71 (71L, 71H), the supply roller 72 (72L, 72H), the doctor blade 73 (73L, 73H), and the agitator 75 (75L, 75H) are all configured as common parts (of the same specifications) that can be used in the small-capacity cartridge 7L and in the large-capacity cartridge 7H.

The second housing 70H principally includes a large-capacity lower frame 300 as an example of a third frame which is configured in such a manner that permits the development roller 71H, the supply roller 72H and the agitator 75H to be rotatably supported therein, and a large-capacity upper frame 400 as an example of a fourth frame which is configured in a manner that permits the doctor blade 73H to be fixed thereto. When the large-capacity lower frame 300 and the large-capacity upper frame 400 are combined together, a second toner reservoir 74H (second developer storage chamber) and a second development chamber 76H are formed.

The second toner reservoir 74H is a chamber for storing toner therein the amount of which is larger than that of toner stored in the first toner reservoir 74L of the small-capacity cartridge 7L, and formed in a front portion of the large-capacity cartridge 7H. The second development chamber 76H is a chamber for accommodating the development roller 71H, the supply roller 72H and the doctor blade 73H, and formed in a rear portion of the large-capacity cartridge 7H. The second toner reservoir 74H and the second development chamber 76H are in communication with each other via a communication passage 77.

The large-capacity lower frame 300 principally includes a pair of sidewalls 301 (of which only one is illustrated) disposed opposite to each other in the right-left direction, and a connecting wall 302 disposed to extend in the right-left direction to connect lower-to-front ends of the pair of sidewalls 301. The right and left sidewalls 301 are configured to form sidewalls of the second development chamber 76H and the second toner reservoir 74H. The connecting wall 302 is configured to form a bottom wall of the second development chamber 76H and bottom and front walls of the second toner reservoir 74H.

Portions of the right and left sidewalls 301 which form the second toner reservoir 74H have a pair of light-transmitting regions 78H disposed opposite to each other in the right-left direction. The light-transmitting regions 78H are transparent portions located in the same position in the respective sidewalls 301 that is closer to a rear edge of the portion of the sidewall 301 which forms the second toner reservoir 74H (i.e., near the communication passage 77), and shaped substantially like a circle in side view. Since the functions of the pair of light-transmitting regions 78H are substantially the same as those of the pair of light-transmitting regions 78L described above, a duplicate description will be omitted.

As shown in FIGS. 2 and 3, in the present embodiment, the pair of light-transmitting regions 78H of the large-capacity cartridge 7H and the pair of light-transmitting regions 78L of the small-capacity cartridge 7L are provided in the same location. In other words, the position of each pair of the light-transmitting regions 78L, 78H is such that the pair of the light-transmitting regions 78L, 78H is located between the light-emitting element 91 and the light-receiving element 92 when the cartridge 7L, 7H is installed in the body casing 2.

To be more specific, the pair of light-transmitting regions 78L, 78H are provided in the small-capacity cartridge 7L and the large-capacity cartridge 7H, respectively, in the same location such that the position of the pair of light-transmitting regions 78L relative to an axis C of rotation of the agitator 75L coincides with that of the pair of light-transmitting regions 78H relative to an axis C of rotation of the agitator 75H. Furthermore, the same location is such that the position of the pair of light-transmitting regions 78L relative to an inner surface of a lower portion of the small-capacity lower frame 100 (indicated in FIG. 2 as a region covered by a bold broken line) coincides with that of the pair of light-transmitting regions 78H relative to an inner surface of a lower portion of the large-capacity lower frame 300 (indicated in FIG. 3 as a region covered by a bold broken line); i.e., the location is same as seen from the respective inner surfaces. Here, the lower portions of the small-capacity and large-capacity lower frames 100, 300 are configured to have their inner surfaces shaped equally to each other, and to define the same region (lower part) which is located at or around the bottom of the toner reservoir 74L, 74H (i.e., the lower portions are disposed in positions lower than the axes C of rotation of the agitators 75L, 75H respectively and positioned equally in accordance with a predetermined arrangement relative to the corresponding agitator 75L, 75H).

As shown in FIG. 3, the large-capacity upper frame 400 is illustrated as a lid-like frame fixed to upper surfaces of the sidewalls 301 and the connecting wall 302 of the large-capacity lower frame 300. The large-capacity upper frame 400 forms an upper wall of the second toner reservoir 74H.

The large-capacity upper frame 400 includes second ribs 410. The second ribs 410 are provided on an undersurface of a portion of the large-capacity upper frame 400 which forms the second toner reservoir 74H. The second ribs 410, each extending in the front-rear direction, are arranged in positions spaced out in the right-left direction (only one first rib 410 is illustrated in FIG. 3) on the undersurface of the large-capacity upper frame 400. Lower sides of the second ribs 410 form a sliding surface along which the free end of the flexible sheet 75D of the agitator 75H being caused to rotate is slidable. In the following description, a rear-side portion (indicated in FIG. 3 as a region covered by a bold broken line) of the sliding surface (lower sides) of the second ribs 410 will be referred to as "second sliding surface 411".

As shown in FIGS. 2 and 3, the first sliding surface 211 of the first ribs 210 and the second sliding surface 411 of the second ribs 410 are disposed in the same location such that the position of the second sliding surface 411 relative to the axis C of rotation of the agitator 75H coincides with that of the first sliding surface 211 relative to the axis C of rotation of the agitator 75L. In other words, the first sliding surface 211 and second sliding surface 411 have the same shape in side view; i.e., the distances from upstream ends thereof in the direction of rotation of the agitators 75H, 75L to the axes C of rotation of the agitators 75H, 75L are equal to each other, and the distances from downstream ends thereof in the direction of rotation of the agitators 75H, 75L to the axes C of rotation of the agitators 75H, 75L are equal to each other. With this configuration, the amounts of flexure, and pressing forces against the sliding surfaces 211, 411, of the flexible sheets 75D, and other factors which may influence the performance of the agitators 75H, 75L in agitating and conveying developer can be made equal to each other, and invariable irrespective of the types of the development cartridge 7.

The wall of the large-capacity upper frame 400 on which the second ribs 410 are provided is recessed outward (outside of the second toner reservoir 74H) more deeply than the wall of the small-capacity upper frame 200 on which the first ribs 210 are provided is recessed outward (outside of the first toner reservoir 74L). To be more specific, a rear-side portion 402 of the wall of the large-capacity upper frame 400 is recessed outward more deeply than a rear-side portion 202 of the wall of the small-capacity upper frame 200, and a front-side portion 403 of the wall of the large-capacity upper frame 400 is recessed outward more deeply than a front-side portion 203 of the wall of the small-capacity upper frame 200.

The first housing 70L and the second housing 70H are configured as described above such that the first housing 70L includes a lower portion which defines a lower part of the first toner reservoir 74L and is disposed below the axis C of rotation of the agitator 75L (the lower portion is indicated in FIG. 2 as a region covered by a bold broken line), the second housing 70H includes a lower portion which defines a lower part of the second toner reservoir 74H and is disposed below the axis C of rotation of the agitator 75H (the lower portion is indicated in FIG. 3 as a region covered by a bold broken line), and the lower portions of the first and second housings 70L, 70H are equally positioned relative to the corresponding agitator 75L, 75H, and have equally shaped inner surfaces; on the other hand, other portions of the first and second housings 70L, 70H which define parts of the first and second toner reservoirs 74L, 74H other than the parts defined by the aforementioned lower portions have inner surfaces shaped differently from each other whereby the capacity of the second toner reservoir 74H is larger than that of the first toner reservoir 74L.

To be more specific, the portions of the connecting walls 102, 302 of the small-capacity lower frame 100 and the large-capacity lower frame 300 from a position near the lower edge of each communication passage 77 to a position frontward of each rotary shaft 75A have the same substantially arcuate shape in cross section. In this way, the walls of the toner reservoir 74L, 74H extending from the position near the lower edge of the communication passage 77 under the agitator 75L, 75H to the position frontward of the rotary shaft 75A have equally shaped inner surfaces.

On the other hand, the small-capacity lower frame 100 has the connecting wall 102 configured to extend from a position frontward of the rotary shaft 75A in a rearwardly and upwardly oblique direction, and then bent frontward to extend along the small-capacity upper frame 200 in a frontwardly and upwardly oblique direction, so that the small-capacity lower frame 100 provides only a little space at its front side between the small-capacity upper frame 200 (front-side portion 203 of the wall) and the small-capacity lower frame 100. In contrast, the large-capacity lower frame 300 has the connecting wall 302 configured to extend from a position frontward of the rotary shaft 75A in a frontwardly and upwardly oblique direction, so that the large-capacity lower frame 300 provides a large space at its front side between the large-capacity upper frame 400 (front-side portion 403 of the wall) and the large-capacity lower frame 300. Accordingly, the capacity of the portion of the large-capacity lower frame 300 which forms the second toner reservoir 74H is larger than that of the portion of the small-capacity lower frame 100 which forms the first toner reservoir 74L.

Furthermore, the small-capacity upper frame 200 (particularly, the front-side portion 203 of the wall thereof) extends generally straight substantially in the front-rear direction, and thus fails to serve to add space to the first toner reservoir 74L, while the large-capacity upper frame 400 is configured to have the rear-side portion 402 and the front-side portion 403 of the wall recessed outward deeply, so that the capacity of the second toner reservoir 74H is increased. Therefore, the capacity of the portion of the large-capacity upper frame 400 which forms the second toner reservoir 74H is larger than that of the portion of the small-capacity upper frame 200 which forms the first toner reservoir 74L. Consequently, the total capacity of the second toner reservoir 74H formed by combining the upper and lower frames 400, 300 together is larger than the total capacity of the first toner reservoir 74L formed by combining the upper and lower frames 200, 100 together.

Furthermore, in the present embodiment, the inner surfaces of the first development chamber 76L and the second development chamber 76H of the first housing 70L and the second housing 70H are shaped equally to each other (see regions covered by bold broken lines in FIGS. 2 and 3, respectively). Moreover, the front-side portions of the small-capacity cartridge 7L and the large-capacity cartridge 7H, including the development chambers 76L, 76H, the development rollers 71 and the supply rollers 72 disposed in the development chambers 76H, 76H, are shaped and configured substantially equally.

As shown in FIGS. 2 and 3, the photoconductor unit 6 is a common unit having a structure to which either one of the small-capacity cartridge 7L and the large-capacity cartridge 7H is detachably attachable in the same position. Each of the small-capacity cartridge 7L and the large-capacity cartridge 7H can be attached to the photoconductor unit 6 to form the process cartridge 5 (see FIGS. 2 and 3), and thus can be removably installed in the body casing 2 by installing, in the body casing 2, the process cartridge 5 in which either of the small-capacity cartridge 7L and the large-capacity cartridge 7H is attached to the photoconductor unit 6.

According to the present embodiment described above, the following advantageous effects can be achieved.

Since the agitators 75L, 75H are constructed of a common part, and the first housing 70L and the second housing 70H are configured such that the predetermined lower part of the first housing 70L which defines the lower part of the first toner reservoir 74L and is disposed below the axis C of rotation of the agitator 75L, and the predetermined lower portion of the second housing 70H which defines the lower part of the second toner reservoir 74H and is disposed below the axis C of the agitator 75H are equally positioned relative to the corresponding agitator 75L, 75H and have equally shaped inner surfaces, the performance levels of the agitators 75L, 75H in agitating and conveying developer can be rendered equivalent to each other.

Since the first housing 70L and the second housing 70H are configured such that the portions of the first and second housings 70L, 70H which define parts of the first and second toner reservoirs 74L, 74H other than the lower parts defined by the aforementioned lower portions have inner surfaces shaped differently from each other so that the capacity of the second toner reservoir 74H is larger than that of the first toner reservoir 74H, each development cartridge 7 can be adapted to have an intended capacity corresponding to a desired amount of toner to be stored in the toner reservoir 74.

To be more specific, in the present embodiment, the portions of the upper and lower frames 300, 400 of the large-capacity cartridge 7H which form the second toner reservoir 74H have capacities larger than those of the portions of the upper and lower frames 100, 200 of the small-capacity cartridge 7L which form the first toner reservoir 74L, respectively; therefore, the second toner reservoir 74H can be designed to have a capacity larger than that of the first toner reservoir 74L.

In the present embodiment, the portion of the large-capacity lower frame 300 which is located frontward of the rotary shaft 75A and the portion of the large-capacity upper frame 400 which forms the second toner reservoir 74H, both of which are portions in which no toner is to be accumulated, are designed to have larger volumes; therefore, no substantial effect is produced by this increase in volume on the performance level of each agitator 75 in agitating and conveying toner.

Since the position of the first sliding surface 211 relative to the axis C of rotation of the agitator 75L coincides with that of the second sliding surface 411 relative to the axis C of rotation of the agitator 75H, the performance levels of each agitators 75 in agitating and conveying toner can be rendered equivalent to each other. Furthermore, since in the present embodiment, the walls 402, 403 on which the second ribs 410 are provided are recessed outward more deeply than the walls 202, 203 on which the first ribs 210 are provided, the capacity of the second toner reservoir 74H is larger than that of the first toner reservoir 74L accordingly, so that the development cartridge 7 can be adapted to have an intended capacity corresponding to a desired amount of toner to be stored therein.

Since the position of the pair of light-transmitting regions 78L relative to the axis C of rotation of the agitator 75L coincides with that of the pair of light-emitting regions 78H relative to the axis C of rotation of the agitator 75H, toner in the toner reservoirs 74L, 74H can be detected under the same conditions. Furthermore, since the inner surfaces of the lower portions of the walls of the toner reservoirs 74L, 74H, in which toner is to be accumulated, are shaped equally while the positions of the pairs of light-transmitting regions 78L, 78H relative to the axes C of rotation of the agitators 75L, 75H, respectively, coincide with each other, determination as to whether or not the toner reservoir 74 is to be replaced can be made simply from the remaining amount of toner as detected, because the remaining amount of toner can be detected under substantially the same conditions independent of the different capacities of the respective toner reservoirs 74.

Since the photoconductor unit 6 is of a universal type designed to be commonly usable for any type of the development cartridge 7, the necessity of providing plural types of photoconductor units 6 for the plural types of development cartridges 7 can be obviated, and thus the costs to be borne by manufacturers who make the image forming system or parts thereof and by consumers who buy the system or parts thereof can be reduced moderately.

Since the first and second development chambers 76L, 76H have equally shaped inner surfaces, the small-capacity cartridge 7L and the large-capacity cartridge 7H can be designed to achieve equal performance in development, and thus the difference in image quality which would be produced by difference in capacity between the development cartridges 7L, 7H installed in the laser printer 1 can be reduced. Furthermore, since the inner surfaces of the development chambers 76L, 76H are shaped equally, commonality of molds and the like for use in forming the housings 70L, 70H can be, at least in part, achieved. Moreover, since the development rollers 71L, 71H and other parts can be designed to have common constructions, commonality of parts among development cartridges 7 can be achieved, and thus the manufacturing costs can be reduced.

Although an illustrative embodiment of the present invention has been described above, the present invention is not limited to the above-described embodiment. Various modifications and changes may be made to the specific structures and arrangement without departing from the scope of the present invention.

In the above-described embodiment, the first development chamber 76L and the second development chamber 76H have equally shaped inner surfaces, but the present invention is not limited to this specific configuration. For example, the inner surface of the first development chamber and the inner surface of the second development chamber may be shaped differently depending on the capacity of the developer container thereof.

In the above-described embodiment, the photoconductor unit 6 is a common unit, but the present invention is not limited to this specific configuration. For example, the photoconductor unit may be a dedicated unit prepared for each developer container having a different capacity.

In the above-described embodiment, a pair of light-transmitting regions 78L, 78H have the same constructions (i.e., both shaped substantially like a circular window in side view) irrespective of the capacity of the development cartridge 7, but the present invention is not limited to this specific configuration. For example, in the above-described embodiment, the light-transmitting region 78H in the large-capacity cartridge 7H may be shaped like a rectangular window. In the above-described embodiment, a pair of light-transmitting regions may be implemented by providing the sidewalls 301 formed, in entirety, of any transparent material.

In the above-described embodiment, the agitators 75L, 75H (first and second agitating members) are constructed as a common part, but the present invention is not limited to this specific configuration. In other words, the present invention can be embodied in practice as long as the first and second agitating members are configured to have constructions equivalent to each other, i.e., to commonly possess the essential features relevant to the performance in agitating and conveying developer. For example, in the above-described embodiment, preferably the flexible sheet 75D is constructed as a common part. On the other hand, features not so relevant to the performance in agitating and conveying developer may be different between the first and second agitating members. To be more specific, for example, in the above-described embodiment, the rotary shaft 75A and the connecting portion 75C may have cross-sectional shapes different between the agitators 75L, 75H.

Specific constructions of the agitators 75L, 75H (agitating members) are shown by way of example only, and the present invention is not limited to these specific constructions. For example, the agitating members may be agitators having no such agitating blades 75B as described in the above embodiment.

Although not described specifically, the small-capacity lower frame 100 (first frame) and the small-capacity upper frame 200 (second frame) which form the first housing 70L, and the large-capacity lower frame 300 (third frame) and the large-capacity upper frame 400 (fourth frame) which form the second housing 70H may be constructed, for example, as a single part or as an assembly of plural parts.

In the above-described embodiment, an illustrative image forming system is described which comprises a body casing 2 (image forming main unit) of the laser printer 1 and two types of development cartridge 7L, 7H either one of which is removably installable in the body casing 2, but the present invention is not limited to this specific configuration. For example, the image forming system consistent with the present invention may comprise three or more types of developer containers wherein any one developer container selected, as desired by a user, from the group including the three or more types of developer container is removably installable in the image forming main unit.

In the above-described embodiment, the development cartridge 7 is illustrated as an example of a developer container, but the present invention is not limited to this specific configuration. For example, a process cartridge in which a photoconductor unit 6 and a development cartridge 7 as in the above-described embodiment are provided inseparably in an integrated unit may be configured as a developer container in accordance with the present invention. Alternatively, a toner cartridge which principally includes a housing and an agitator disposed in a toner reservoir formed by the housing (but fails to include development roller 71, supply roller 72, doctor blade 73 and development chamber as in the above-described embodiment) may be configured as a developer container in accordance with the present invention.

In the above-described embodiment, the present invention is applied to the laser printer 1 for forming a monochrome image, but the present invention is not limited thereto; any other image forming apparatus such as a photocopier, a multifunction peripheral and the like which includes a document scanning device (e.g., flat bed scanner) may be configured in accordance with one or more of the embodiments of the present invention.

What is claimed is:

1. An image forming system comprising:

a first developer container configured to store developer;

a second developer container configured to store developer, the second developer container having a capacity larger than the first developer container; and an image forming main unit having a structure configured to allow one developer container selected from a group including the first developer container and the second developer container to be removably installed therein, wherein the first developer container includes a first housing and a first agitating member, the first housing being configured to form a first developer storage chamber in which developer is storable, the first agitating member being rotatable to agitate the developer in the first developer storage chamber, wherein the second developer container includes a second housing and a second agitating member, the second housing being configured to form a second developer storage chamber in which developer is storable, the second agitating member being rotatable to agitate the developer in the second developer storage chamber, the second agitating member having a construction equivalent to that of the first agitating member, wherein the first housing includes a lower portion that defines a lower part of the first developer storage chamber and is disposed below an axis of rotation of the first agitating member, and the second housing includes a lower portion that defines a lower part of the second developer storage chamber and is disposed below an axis of rotation of the second agitating member, the lower portions of the first and second housings being equally positioned relative to the corresponding agitating member and having equally shaped inner surfaces, while the first and second housings further include portions that define parts of the first and second developer storage chambers other than the lower parts defined by the lower portions, and have inner surfaces shaped differently from each other whereby the capacity of the second developer storage chamber is larger than that of the first developer storage chamber, wherein the first housing includes a first frame and a second frame combined together to form the first developer storage chamber, and the second housing includes a third frame and a fourth frame combined together to form the second developer storage chamber, and wherein a portion of the third frame which forms the second developer storage chamber has a capacity larger than a portion of the first frame which forms the first developer storage chamber, and a portion of the fourth frame which forms the second developer storage chamber has a capacity larger than a portion of the second frame which forms the first developer storage chamber.

2. The image forming system according to claim 1, wherein the second frame includes a first rib having a first sliding surface along which the first agitating member caused to rotate is slidable, and the fourth frame includes a second rib having a second sliding surface along which the second agitating member caused to rotate is slidable, wherein a position of the second sliding surface relative to an axis of rotation of the second agitating member coincides with a position of the first sliding surface relative to an axis of rotation of the first agitating member, and wherein a wall of the fourth frame on which the second rib is provided is recessed outward more deeply than a wall of the second frame on which the first rib is provided.

3. The image forming system according to claim 1, wherein the first housing includes a pair of first light-transmitting regions provided in opposed sidewalls of the first developer storage chamber to allow light emitted from the image forming main unit for use in determining whether or not time is ripe for the first developer container to be replaced to pass through the first developer storage chamber, and the second housing includes a pair of second light-transmitting regions provided in opposed sidewalls of the second developer storage chamber to allow light emitted from the image forming main unit for use in determining whether or not time is ripe for the second developer container to be replaced to pass through the second developer storage chamber, and wherein a position of the pair of first light-transmitting regions relative to an axis ofrotation of the first agitating member coincides with a position of the pair of second light-transmitting regions relative to an axis of rotation of the second agitating member.

4. The image forming system according to claim 1, further comprising a photoconductor unit removably installed in the image forming main unit, the selected one developer container being detachably attachable to the photoconductor unit whereby the selected one developer container is removably installable together with the photoconductor unit in the image forming main unit, and the photoconductor unit includes a photoconductor to be supplied with developer from the selected one developer container installed, to form a developer image thereon.

5. The image forming system according to claim 1, wherein the first developer container includes a first developer bearing member configured to bear developer, a first developer supply member configured to supply developer to the first developer bearing member, and a first doctor blade configured to regulate a thickness of the developer on the first developer bearing member;

wherein the second developer container includes a second developer bearing member configured to bear developer, a second developer supply member configured to supply developer to the second developer bearing member, and a second doctor blade configured to regulate a thickness of the developer on the second developer bearing member;

wherein the first housing includes a first development chamber in which the first developer bearing member, the first developer supply member and the first doctor blade are disposed;

wherein the second housing includes a second development chamber in which the second developer bearing member, the second developer supply member and the second doctor blade are disposed;

wherein the first developer bearing member has a construction equivalent to that of the second developer bearing member, the first developer supply member has a construction equivalent to that of the second developer supply member and the first doctor blade has a construction equivalent to that of the second doctor blade; and wherein the first and second development chambers have equally shaped inner surfaces.

* * * * *